US010195754B2

(12) United States Patent
Bozikis et al.

(10) Patent No.: US 10,195,754 B2
(45) Date of Patent: Feb. 5, 2019

(54) SHAVING BLADE CARTRIDGE, A SHAVER COMPRISING SUCH SHAVING BLADE CARTRIDGE AND A METHOD OF MANUFACTURING SUCH A SHAVING BLADE CARTRIDGE

(71) Applicant: BIC-VIOLEX SA, Anixi (GR)

(72) Inventors: Ioannis Bozikis, Koukaki-athens (GR); Georgios Georgakis, Melisia (GR); Phaedon Papageorgis, Holargos (GR); Dimitrios Efthimiadis, Nea Kypseli (GR); Vasileios Davos, Ilion (GR); Georgios Koulourias, Marousi (GR); Petros Polychronidis, Nea Erythrea (GR)

(73) Assignee: BIC VIOLEX SA, Anixi (GR)

( * ) Notice: Subject to any disclaimer, the term of this patent is extended or adjusted under 35 U.S.C. 154(b) by 16 days.

(21) Appl. No.: 15/730,959

(22) Filed: Oct. 12, 2017

(65) Prior Publication Data

US 2018/0029243 A1 Feb. 1, 2018

Related U.S. Application Data

(63) Continuation of application No. 15/113,834, filed as application No. PCT/EP2014/053880 on Feb. 27, 2014.

(51) Int. Cl.
*B26B 21/40* (2006.01)
*B26B 21/22* (2006.01)

(52) U.S. Cl.
CPC ..... *B26B 21/4031* (2013.01); *B26B 21/227* (2013.01); *B26B 21/4012* (2013.01);
(Continued)

(58) Field of Classification Search
CPC ..... B26B 21/4031; B26B 21/227; B26B 21/4012; B26B 21/4018
(Continued)

(56) References Cited

U.S. PATENT DOCUMENTS 9,751,229 B2 * 9/2017 Hodgson ..... B26B 21/48
2006/0070242 A1 * 4/2006 Szczepanowski ..... B26B 21/48 30/140

(Continued)

FOREIGN PATENT DOCUMENTS

WO 2005-011930 A1 2/2005
WO 2005-090023 A1 9/2005

(Continued)

OTHER PUBLICATIONS

International Search Report of PCT/EP2014/053880, dated Oct. 23, 2014.

*Primary Examiner* — Omar Flores Sanchez
(74) *Attorney, Agent, or Firm* — Polsinelli PC

(57) ABSTRACT

A shaving blade cartridge includes a housing extending along a longitudinal axis having a top side, a bottom side opposite to the top side, and first and second longitudinal sides each extending longitudinally along the longitudinal axis between the top and bottom sides. A primary cutting blade is mounted on the housing between the first and second longitudinal sides, and has a cutting edge. A primary cap is located rearward of the cutting edge. A primary guard is located forward of the cutting edge. A trimming element, mounted on the housing, has a trimming edge. The trimming edge and the cutting edge are opposite one another. The primary cap is provided on a rear element, and the rear element is fitted on the housing. The trimming element is sandwiched between the housing and the primary cap.

16 Claims, 7 Drawing Sheets

(52) U.S. Cl.
CPC ..... *B26B 21/4018* (2013.01); *B26B 21/4025* (2013.01); *B26B 21/4043* (2013.01); *B26B 21/4068* (2013.01)

(58) Field of Classification Search
USPC ..... 30/50, 77, 51, 59, 34.1
See application file for complete search history.

(56) References Cited

U.S. PATENT DOCUMENTS

| | | | | |
|---|---|---|---|---|
| 2006/0123631 | A1* | 6/2006 | Szczepanowski .... | B26B 21/225 30/44 |
| 2011/0023305 | A1* | 2/2011 | Whelan ..... | B26B 21/227 30/34.1 |
| 2012/0279070 | A1* | 11/2012 | Seo ..... | B26B 21/4012 30/34.2 |
| 2017/0326743 | A1* | 11/2017 | Hodgson ..... | B26B 21/4012 |

FOREIGN PATENT DOCUMENTS

| | | | |
|---|---|---|---|
| WO | 2008-023210 | A1 | 2/2008 |
| WO | 2009-049216 | A1 | 4/2009 |
| WO | 2011-017239 | A1 | 2/2011 |
| WO | 2011-075505 | A1 | 6/2011 |
| WO | 2013-122900 | A1 | 8/2013 |

* cited by examiner

SHAVING BLADE CARTRIDGE, A SHAVER COMPRISING SUCH SHAVING BLADE CARTRIDGE AND A METHOD OF MANUFACTURING SUCH A SHAVING BLADE CARTRIDGE

CROSS-REFERENCE TO RELATED APPLICATIONS

This application is a continuation of U.S. application Ser. No. 15/113,834, filed Jul. 24, 2016, which is a national stage application of International Application No. PCT/EP2014/053880, filed Feb. 27, 2014, the entire contents of which are all incorporated herein by reference for all purposes.

FIELD OF THE INVENTION

The embodiments of the present invention relate to shaving blade cartridges, shavers having such shaving blade cartridges, and methods of manufacturing such shaving blade cartridges.

BACKGROUND OF THE INVENTION

In particular, the embodiments of the present invention relate to a shaving blade cartridge that includes:

a housing extending along a longitudinal axis having a top side and a bottom side opposite to the top side and first and second longitudinal sides each extending longitudinally along the longitudinal axis between the top and bottom sides, a primary cutting blade mounted on the housing between the first and second longitudinal sides, and having a cutting edge, a primary cap, the primary cap being located rearward of the cutting edge, a primary guard, the primary guard being located forward of the cutting edge and, a trimming element, mounted on the housing, having a trimming edge, the trimming edge and the cutting edge being opposite. In other words, the trimming edge and the cutting edge are located facing opposite direction.

U.S. Pat. No. 6,276,061 describes a shaving blade cartridge that includes a housing in which primary blades and an additional trimming blade are mounted. The housing of the shaving blade cartridge is a one-piece frame and includes slots in which the primary blades and the additional trimming blade are mounted and fastened. The fastening of the additional trimming blade into the housing leads to important manufacturing tolerances and to manufacturing method complicated to be implemented. The shaving blade cartridge manufacturing time and costs are thus increased.

WO2005011930 also describes a shaving blade cartridge having a primary guard, a primary cap, a trimming cap and a trimming comb guard. The shaving blade cartridge includes a trimming blade and primary blades. The trimming blade is part of an assembly mounted on the housing and includes a trimming blade carrier. The trimming assembly including the trimming blade and the trimming guard is attached to the back of the housing. Such shaving blade cartridge allows fastening of the trimming blade, and more precisely, the trimming blade assembly after the manufacturing process of the housing and after the positioning of the primary blades. However, the shaving blade cartridge of WO2005011930 includes the trimming assembly, which is one more piece and which could lead to an increase of the total weight and the dimensions of the shaving blade cartridge.

The embodiments of the present invention have objectives to mitigate the drawbacks discussed above. The manufacture of the present shaving blade cartridge is simpler without affecting the shaving's quality.

SUMMARY OF THE INVENTION

To this aim, according to an embodiment of the invention, a shaving blade cartridge is provided where the primary cap is provided on a rear element, the rear element is fitted on the housing, and the trimming element is sandwiched between the housing and the primary cap.

With these features, no member or organ specific to the trimming element is needed to fasten the trimming element to the housing. Moreover, the rear element can easily be fastened to the housing without any special tooling. Also, the trimming element is integrated to the shaving blade cartridge on an esthetical way. The trimming element is thus held tightly in position. Moreover, less material is used as raw material for the cover.

In some embodiments of the present invention, a person of ordinary skill in the art may also include one or more of the following features:

the primary cutting blade extends along the longitudinal axis; the primary cutting blade thus extends along the same direction as that of the housing, which allows a reduction of the size of the shaving blade cartridge if needed;

the trimming element extends along the longitudinal axis; the housing and the trimming element extends both along the same axis;

the trimming element includes a trimming blade support and a trimming blade, the trimming blade has the trimming edge, and the trimming blade is supported by the trimming blade support; in other words, the trimming blade is supported by a trimming blade support which allows a certain strength; the trimming blade could also be a bent blade (in that case, no trimming blade support is needed);

the trimming blade edge extends in a trimming blade edge plane;

the primary cutting blade extends in a cutting blade plane;

an angle provided between the trimming edge plane and the trimming plane is between 10° and 40°, and is preferably about 20°; such angle range allows a pleasant and effective trimming;

the housing is further provided with a trimming guard located forward of the trimming edge; the trimming guard provides a more pleasant trimming;

the trimming edge extends in a trimming edge plane;

the trimming guard defines a trimming plane;

the rear element is press-fitted on the housing; the press fit allows a solid assembly;

the housing includes a recess located between the primary cutting blade and the first longitudinal side;

the rear element includes a T-shape with a first arm extending in the recess, and a second arm extending in the continuity of the top side of the housing;

the first arm includes a plurality of legs extending in a direction transversal to the second arm;

wherein the housing includes a plurality of recesses located between the primary blade and the second longitudinal side, and each leg of the first arm being press-fitted in a corresponding recess of the housing;

the rear element is snap-fitted on the housing;

the housing includes a recess located between the primary cutting blade and the first longitudinal side;

the rear element is snap fitted in the recess;

the rear element includes a V-shape with two arms, a first arm and a second arm;

the first arm extends in the recess;

the second arm extends in the continuity of the top side of the housing;

the first arm includes a hook, where the recess includes a protrusion, and the hook cooperates with the protrusion; the hook-protrusion cooperation allows an effective snap-fitting;

the second arm of the rear element snap fitted in the housing defines a slot with the housing, the trimming blade support extending in the slot;

the shaving blade cartridge further includes two clips retaining the primary cutting blade on the housing;

the trimming element is smaller in length than the distance between the two clips along the longitudinal axis; the fixation of the trimming element is independent of the clips; the trimming element may be at least as long as the distance between the two clips along the longitudinal axis;

the rear element is further provided with a trimming cap located rearward of the trimming edge; the trimming cap is directly integrated to the rear element;

the trimming guard defines a trimming plane;

the trimming element at rest has a negative exposure with regard to the trimming plane, and preferably the exposure is about −50 [tm to −100 [tm (micrometers);

the trimming element at rest has a positive exposure with regard to the trimming plane, and preferably the exposure is equal to 120 [tm (micrometers); such exposure allows a pleasant and effective trimming; the trimming element at rest can also have a negative exposure with regard to the trimming plane; for example the negative exposure can be of about 50 [tm;

the distance between the trimming edge and the trimming guard is between 400 [tm and 650 [tm (micrometers), and is preferably about 580 [tm or 590 [tm (micrometers), or is preferably about 410 micrometers; such distance allows a pleasant and effective trimming;

the rear element is further provided with a trimming cap located rearward of the trimming edge;

the primary rear cap and/or the trimming cap is (are) provided with a lubrication strip;

the housing includes through holes, which are provided beyond the trimming blade: the through holes allows the through flow of rinsing water.

The embodiments of the present invention are also directed to a shaver including a handle and a shaving blade cartridge as described above, the shaving blade cartridge being connected to the handle.

The embodiments of the present invention are also directed to a method of manufacturing a shaving blade cartridge includes providing a housing extending along a longitudinal axis having a top side, a bottom side opposite to the top side, and first and second longitudinal sides, each extending longitudinally along the longitudinal axis between the top and bottom sides; providing a primary guard; assembling a primary guard to the housing, providing a trimming element having a trimming edge; placing the trimming element on the housing, the housing having protrusions being arranged to hold the trimming element, providing a rear element; fixing the trimming element on the housing by fitting the rear element on the housing; mounting a primary cutting blade on the housing between the first and second longitudinal sides, the primary cutting blade having a cutting edge such that the cutting edge and the trimming edge are opposite, the primary guard being located forward of the cutting edge. In another embodiment of the present invention, the primary guard is in one piece with the housing; in that case, there is no need having a step in which the primary guard is assembled to the housing. In any cases, the order of the steps of the methods as defined above is to be respected to achieve properly the manufacture of the shaving blade cartridge.

BRIEF DESCRIPTION OF THE DRAWINGS

Other characteristics and advantages of the embodiments of the present invention will readily appear from the following description of one of its embodiments, provided as non-limitative examples, and shown in the accompanying drawings.

On the different figures, the same reference signs designate like or similar elements.

DETAILED DESCRIPTION

Figure 1:
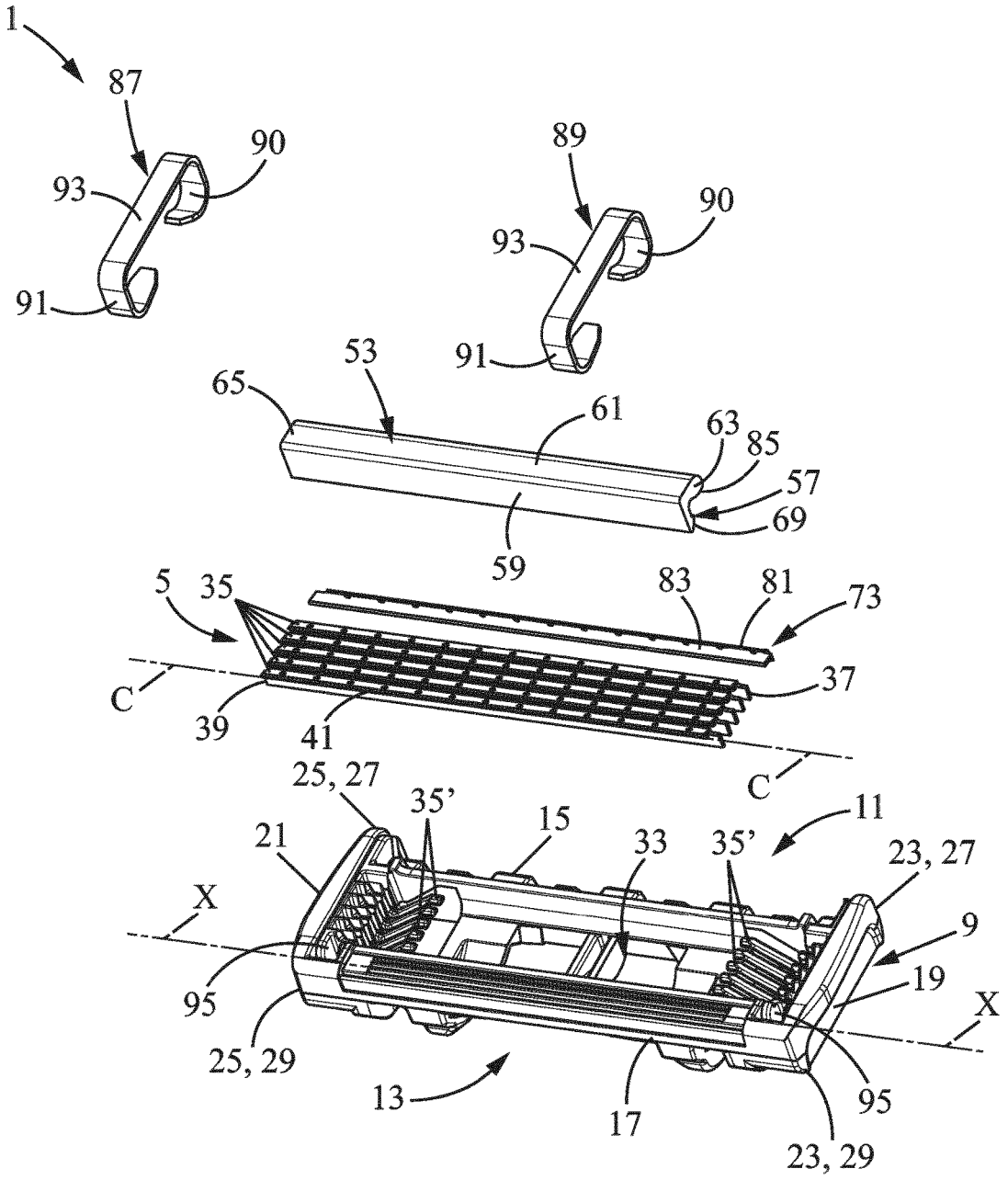
FIG. 1 is a perspective view of a shaving blade cartridge according to the present invention.

FIG. 1 shows a shaving blade cartridge 1 according to the present invention. The shaving blade cartridge 1 is adapted to be attached to a handle 7 to form a wet razor 3 as illustrated on FIG. 12. The shaving blade cartridge 1 is provided with one or more blades 5. The blades 5 are not driven by a motor relative to the shaving blade cartridge 1.

Figure 9:
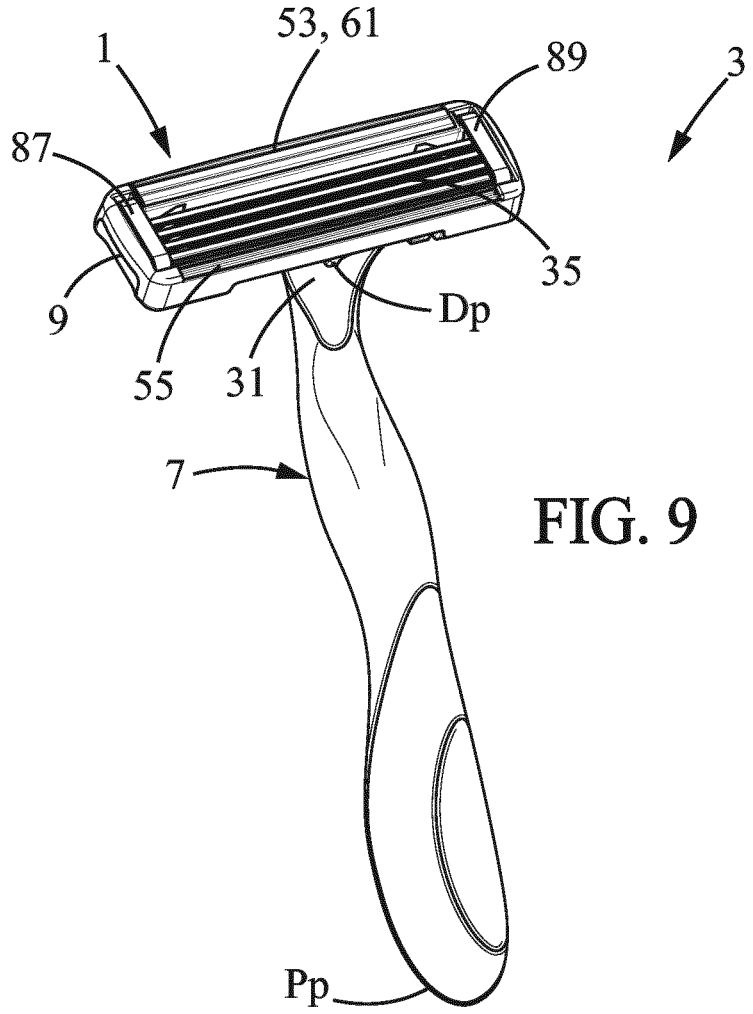
FIG. 9 shows a perspective view of a shaver including a handle and a shaving blade cartridge, according to the present invention.

As shown in FIG. 9, the shaving blade cartridge 1 can be attached to a handle 7 extending in a handle direction between a proximal portion Pp and a distal portion Dp. The handle 7 can pivot with regard to the shaving blade cartridge 1. The handle can pivot with regard to the shaving blade cartridge from a rest position, in which the handle is free of constraints toward two opposite directions. In another embodiment of the present invention, the handle 7 can pivot from a rest position toward one sole direction. In other embodiments of the present invention, the handle 7 may also be fixed with regard to the shaving blade cartridge 1. The handle direction may be curved or include one or several straight portions. The shaving blade cartridge 1 can, for example, be releasably connected to the handle 7 through a lock-and-release mechanism as detailed hereafter.

As depicted in the figures, the shaving blade cartridge 1 includes a housing 9. The housing 9 extends along a longitudinal axis X-X. Viewed from the top, the housing 9 has a rectangular general shape. However, in some embodiments, the general shape of the housing 9 may be different, for example the housing 9 could have an oval shape, a square shape, or a circular shape. The housing 9 includes a top side 11, a bottom side 13 opposite to the top side 11, and a first and second longitudinal side 15, 17. For example, the bottom side 13 is adapted to be arranged in front of the handle 7, whereas the top side 11 is arranged opposite to the bottom side 13. The top side 11 and the bottom side 13 can be parallel to each other.

As shown in FIG. 1, the first longitudinal side 15 extends along the longitudinal axis X-X. The second longitudinal side 17 and the first longitudinal side 15 are facing each other. The second longitudinal side 17 may be approximately parallel to the first longitudinal side 15, especially when the first and second longitudinal sides 15, 17 are flat. The first and second longitudinal sides 15, 17 can also have subtle or noticeable opposing inclinations. The first and second longitudinal sides 15, 17 can also have curved surfaces. The second longitudinal side 17 also extends along the longitudinal axis X-X. The first and the second longitudinal sides 15, 17 each extends in a lateral direction Z along a lateral axis Z-Z (shown in FIG. 7) between the top side 11 and the bottom side 13 of the housing 9. The lateral axis Z-Z intersects the longitudinal axis X-X. For example, the longitudinal axis X-X and the lateral axis Z-Z may be orthogonal to each other.

Figure 3:
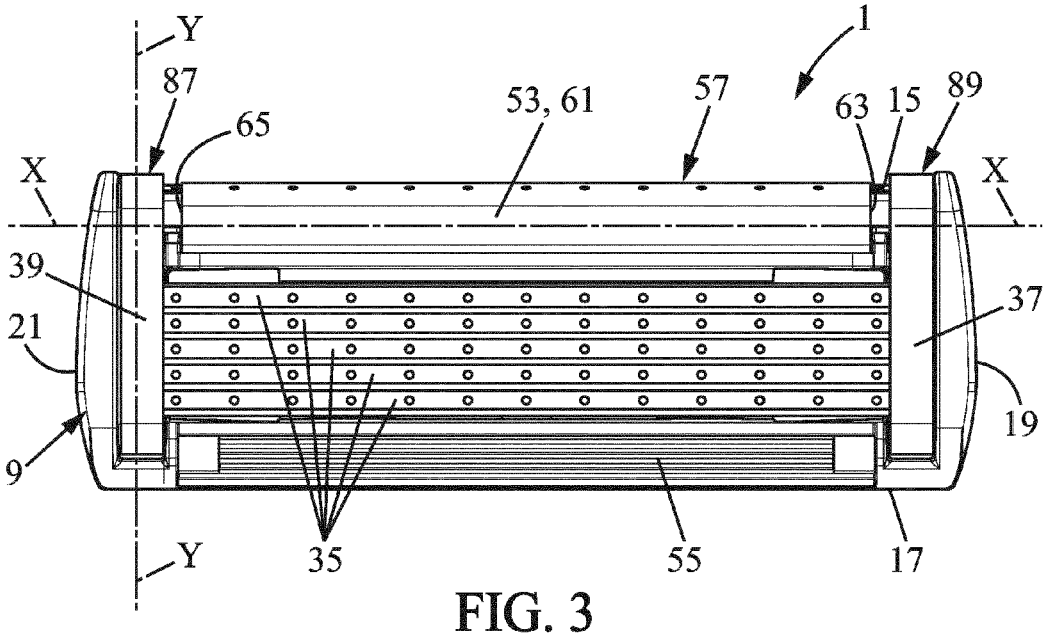
FIG. 3 is a top view of the shaving blade cartridge in FIG. 1.

The housing 9 may also include, as shown in FIGS. 1 and 3, first and second lateral sides 19, 21 which extend between the first and second longitudinal sides 15, 17, along a transversal axis Y-Y. The transversal axis Y-Y is transverse to the longitudinal axis X-X. The transversal axis Y-Y can be, for example, orthogonal to the longitudinal axis X-X and to the lateral axis Z-Z. The first and second lateral sides 19, 21 are arranged, in the lateral direction Z, between the top side 11 and the bottom side 13. The first and second lateral and longitudinal sides 15, 17, 19, 21 form together the external surface of the housing 9.

The first and second lateral sides 19, 21 both join the longitudinal ends 23, 25 of the first and second longitudinal sides 15, 17. In a similar way, the first and second longitudinal sides 15, 17 both join the free ends 27, 29 of the first and second lateral sides 19, 21. The housing 9 can be made of a plastic material. However, other materials can be used. For example, the housing 9 can be made of a metallic material. Moreover, the housing 9 can be made with a combination of two or more different materials. For example, a part of the housing 9 may be made of a first material, whereas the other part of the housing is made with a second material.

The housing 9 can for example include, on the bottom side 13, a connection mechanism 31 (shown in FIG. 9) adapted to connect to the handle 7. The connection mechanism 31 can thus allow the release and/or the attachment of the shaving blade cartridge 1 to the handle 7.

The housing 9 also includes a blade receiving section 33, as represented in FIG. 1. The blade receiving section 33 or blade receiving area may have a general rectangular shape viewed from a top view. The blade receiving section 33 is arranged on the top side 11 of the housing 9. The blade receiving section 33 defines a recess and is adapted to receive at least one primary cutting blade 35. In other words, the shaving blade cartridge 1 includes at least one primary cutting blade 35. The primary cutting blade 35 is mounted on the housing between the first and second longitudinal sides 15, 17, and has a cutting edge 41.

As shown in FIGS. 1, 2, 3 and 7, the shaving blade cartridge 1 includes five primary cutting blades. However, in other embodiments, the shaving blade cartridge 1 can have more or less than five primary cutting blades 35. For example the shaving blade cartridge 1 can include three primary cutting blades.

The primary cutting blades 35 are mounted in the housing 9 in the blade receiving section 33 between the first and second longitudinal sides 15, 17 of the housing 9 and between the first and second lateral sides 19, 21 of the housing 9. As shown in FIGS. 1 and 3, each primary cutting blade 35 extends longitudinally along a cutting blade axis. For example, the cutting blade axis C-C coincides with the longitudinal axis X-X. Each primary cutting blade 35 includes a first and second end 37, 39 along the longitudinal axis X-X, and is directed toward the first longitudinal side 15. The first end 37 of the primary cutting blades 35 is directed toward the first lateral side 19 of the housing 9, whereas the second end 39 of the primary cutting blade 35 is directed toward the second lateral side 21 of the housing 9. Each primary cutting blade 35 includes a cutting edge 41. The cutting edge 41 extends along the cutting blade axis C-C. The cutting edge 41 of the primary cutting blade 35 is accessible at the top side 11 of the housing 9 to cut hair during the "main' or "primary" shaving.

Figure 2:
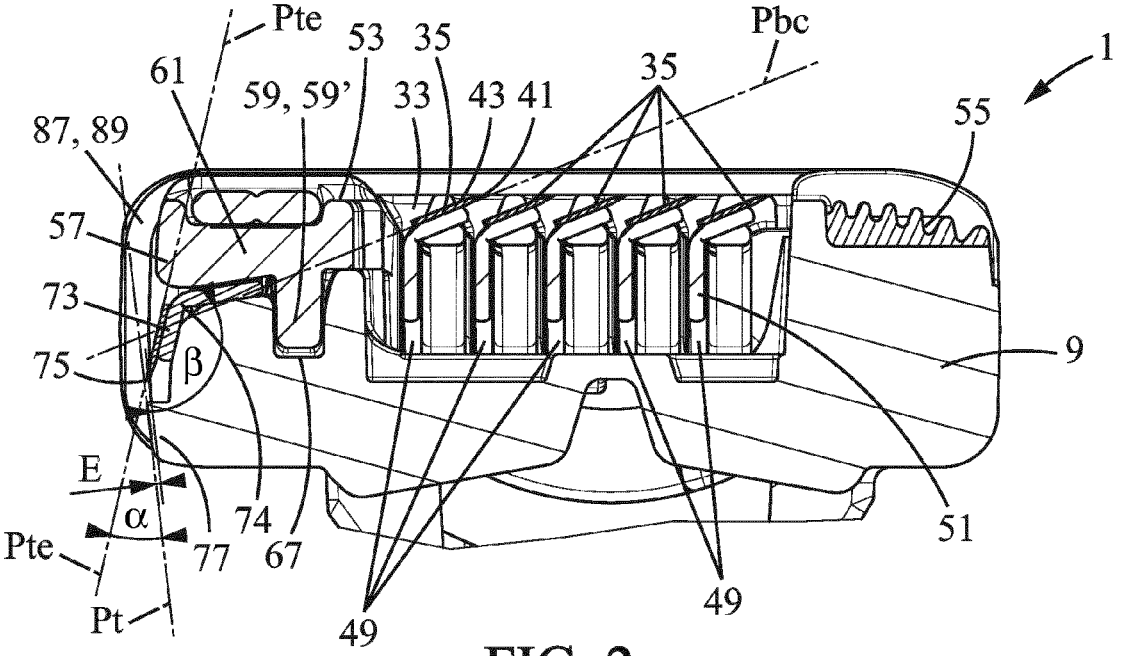
FIG. 2 is a cross sectional view of the shaving blade cartridge of FIG. 1 including a rear element press-fitted in the housing according to a first embodiment of the present invention.
Figure 7:
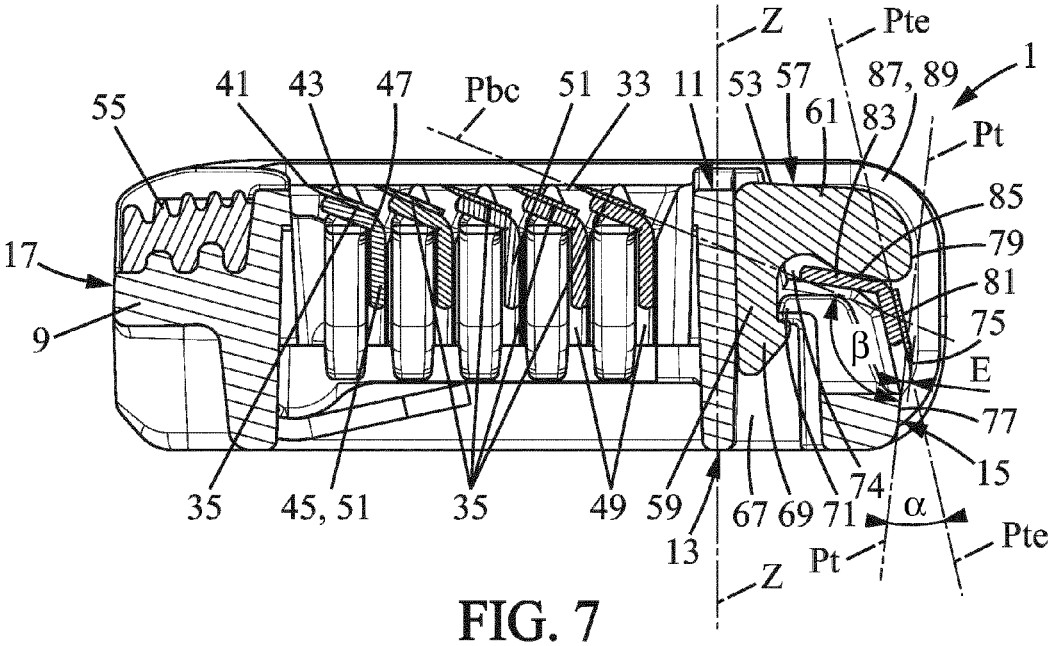
FIG. 7 is a cross sectional view of the shaving blade cartridge of FIG. 1 including a rear element snap-fitted in the housing according to a second embodiment of the present invention.

For example, the primary cutting blades 35 are L-shaped as illustrated in FIGS. 2 and 7. The primary cutting blades 35 have a cutting edge portion 43, a guided portion 45, and a bent portion 47 which is intermediate to the cutting edge portion 43 and the guided portion 45. The primary cutting edge portion 43 extends along a cutting edge portion axis. Advantageously, the cutting edge portion axis of all cutting blades 35 are positioned parallel to each other.

Each primary cutting blade 35 can be freely mounted in the housing 9. More precisely, the primary cutting blades 35 are movably mounted in the blade receiving section 33. Each primary cutting blade 35 is, for example, supported by two elastic fingers. The elastic fingers can be molded as a single piece with the housing 9 and can extend in the blade receiving section 33 towards each other and upwardly from both lateral sides 19, 21 of the housing 9. As shown in FIG. 2, the guided portions 45 of the primary cutting blades 35 are slidingly guided in slots 49 provided in the housing 9. For example, the primary cutting blade 35 can be provided with its cutting edge 41 fixed on a blade support 51 which includes the guided portion 45 and the bent portion 47. In the illustrated embodiment of the present invention, the blade support 51 is carried by the elastic fingers.

However, in some others embodiments of the present invention (not shown on the figures) the primary cutting blades could be bent blades, as described for instance in patent application WO2013/050606, or curved blades.

According to the present invention, the shaving blade cartridge 1 includes a primary cap 53. The primary cap 53 is located rearward of the cutting edge 41. The primary cap 53 is located toward the first longitudinal side 15. The shaving blade cartridge 1 also includes a primary guard 55. The primary guard 55 is located forward of the cutting edge 41. The primary guard 55 is located toward the second longitudinal side 17.

As represented in FIGS. 1, 2, 3 and 7, the primary cap 53 is provided on a rear element 57.

Figure 5:
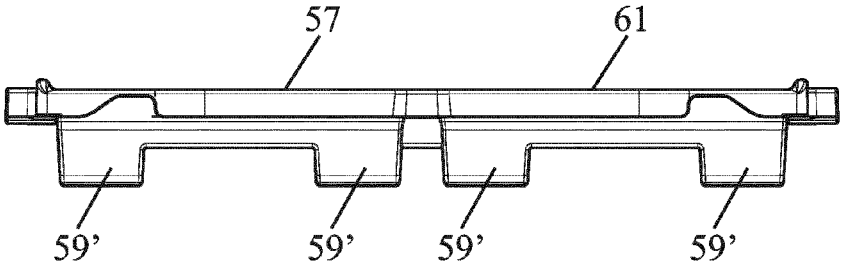
FIG. 5 is a side view of the rear element of FIG. 2.

According to a first embodiment of the present invention, as shown in FIGS. 2 and 5, the rear element 57 has a T-shape with two arms 59, 61. The first arm 59 extends transversely from the second arms 61. More precisely, the second arm 61 extends along a direction which is orthogonal to the direction of extension of the first arm 59. An end of the first arm 59 is fixed to a middle portion of the second arm 61.

According to a second embodiment of the present invention, as shown in FIG. 7, the rear element 57 can have a V-shape with two arms 59, 61. The first and second arms 59, 61 extend along a first and second direction. The first and second directions are approximately orthogonal. However, the first and second directions can define an angle different than 90°, which can be an acute or obtuse angle.

As shown in FIGS. 2, 3, and 7, the rear element 57 extends along the longitudinal axis X-X between a first and a second free end 63, 65. For example, the first free end 63 of the rear element 57 is located toward the first end 37 of the primary cutting blade 35, whereas the second free end 65 of the rear element 57 is located toward the second end 39 of the primary cutting blade 35. The length of the rear element 57 is smaller than the length of the housing 9 along the longitudinal axis X-X.

The second arm 61 is preferably provided with the primary cap 53. The primary cap 53 is, for example, provided with a lubricating strip used during the "main" shaving. The second arm 61 extends outside of the housing 9. The second arm 61 extends on the top side 11 of the housing 9.

More particularly, the second arm 61 extends outside of the housing 9, and can form with the external surfaces of the housing 9, for example with the top side 11 of the housing 9, a continuous surface.

Figure 4:
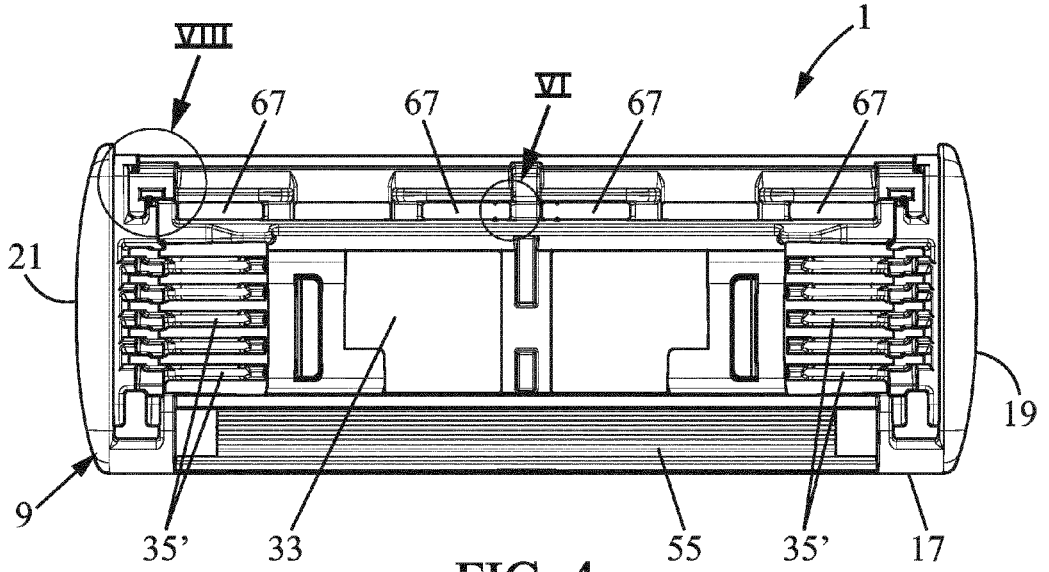
FIG. 4 is a top view of the housing of the shaving blade cartridge according to the first embodiment showing recesses.

According to the first embodiment of the present invention, as shown in FIG. 2, the first arm 59 is press fitted in the housing. The first arm 59 includes a leg 59' which cooperates with a recess 67. The recess 67 is located between the primary cutting blade 35 and the first longitudinal side 15. More precisely, the first arm 59 includes a plurality of legs 59', each leg 59' cooperating with a dedicated recess 67. As shown in FIGS. 4 and 5, the first arm 59 includes four legs 59' which are press-fitted into recesses 67 provided in the housing 9. For example, the number of recesses 67 can be at least two and is preferably four. One leg 59' and one recess 67 form a press fit pair. Each leg 59' matches with one corresponding recess 67. Thus, four press fit pairs are formed, which allow to increase the holding pressure of the rear element 57 into the housing 9. In other embodiments of the present invention, less or more press fit pairs can be provided. For example, the first leg could have only three legs, each of the three legs cooperating with one dedicated recess. In an alternative embodiment of the present invention, the recess can be provided on the rear element whereas the leg is provided on the housing.

Figure 6:
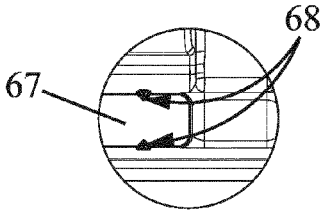
FIG. 6 is a detailed view of circle portion VI of FIG. 4 showing a protrusion located in the recesses of the housing.

Each recess 67 is defined by an interior wall. The interior wall of the recess may be provided with protrusions 68. As shown in FIG. 6, triangular protrusions 68 may be provided to interact with the rear element 57 when the rear element 57 is pressed into position. However, the protrusion 68 may have other shapes. The protrusions 68 are permanently deformed when the rear element 57 is press-fitted on the housing 9. The protrusions 68 add gripping force to further secure the rear element 57 in position. In other words, the protrusions 68 will be plastically deformed by the legs 59' of the rear element 57 when the rear element 57 is fixed to the housing 9. The rear element 57 and the housing 9 can be made of a plastic material. These protrusions 68 allow the material elastic limit of the rear element 57 and the housing 9 to be kept below the failure value.

According to the second embodiment of the present invention, as shown in FIG. 7, the first arm 59 is snap fitted in the housing 9. More precisely, the first arm 59 cooperates with a recess 67 provided on the housing 9. The recess 67 is located between the primary cutting blade 35 and the first longitudinal side 15. The first arm 59 includes a hook 69 which cooperates with a protrusion 71 provided in the recess 67. The hook 69 is provided at the free end of the first arm 59. The cooperation of the hook 69 and the protrusion 71 forms the snap fit, i.e. a gripping action effected solely by the inherent resistance to deformation of the material of the hook 69 and/or protrusion 71. The protrusion 71 and the rear element 57 can be made of a deformable plastic material. However, other materials having inherent resistance to deformation to form a snap fit connection could be used. In others embodiments of the present invention, the first arm 59 can be provided with a recess which cooperate with a protrusion provided on the housing 9. The shape of the protrusion can be a hook or other shapes which allow a snap fitting. For example, the housing can be provided with an arm with a hook which cooperates with a cavity or a hole provided on the rear element.

As shown in FIGS. 2 and 7, a trimming element 73 is sandwiched between the rear element 57 and the housing 9 such as to allow a trimming shaving with the razor 3. More particularly, the rear element 57 and the housing define a recess or a slot 74 in which the trimming element 73 extends and is fastened by the rear element 57 being fitted in the housing 9. The trimming element 73 can extend along the longitudinal axis X-X.

The trimming element 73 has a trimming edge 75. The trimming edge 75 and the cutting edge 41 of the primary cutting blade 35 are opposite. In other words, the trimming edge 75 and the cutting edge 41 are located facing opposite direction. For instance, the trimming edge 75 is directed toward the bottom side 13 of the housing 9, whereas the cutting edge is directed beyond the top side 11 of the housing 9.

As represented in FIGS. 2 and 7, the trimming element 73 includes a trimming blade 81. The trimming element 73 can be similar to the primary cutting blade 35. For example, the trimming element 73 can have the same shape than the primary cutting blade 35.

In an embodiment of the present invention, the trimming blade 81 can have another shape, or other dimensions than the primary blade. It can especially have a shorter blade length. The trimming blade allows a better shaving of skin areas constricted by adjacent protruding facial features, e.g. skin areas situated under the nose, near the ears, and the same. Thus the trimming shaving is in particular the shaving of skin areas constricted by adjacent protruding facial features with a trimming element. The trimming shaving allows a precision shaving.

As shown in FIGS. 2 and 7, the trimming element 73 includes a trimming blade support 83 and a trimming blade 81. The trimming blade 81 includes the trimming edge 75, and the trimming blade 81 is supported by the trimming blade support 83. The trimming blade support 83 extends in the slot 74 defined by the rear element 57 and the housing 9. The trimming blade support 83 is fastened to the housing 9 by the snap fitting of the rear element 57 into the housing 9. The trimming blade support 83 is thus sandwiched between the rear element 57 and the housing. For instance, the rear element 57 includes a portion adapted to exert retention force (or clamping force) on the trimming element 73, and more particularly on the trimming blade support 83 of the trimming element 73. The second arm 61 includes the portion adapted to exert retention force on the trimming element 73. The rear element 57 fitted in the housing 9 applies pressure to the trimming element 73 to hold it in position. More precisely, the rear element 57 exerts a retention force on the trimming element 73 directed toward the bottom side 13 of the housing 9. The retention force of the rear element 57 on the trimming element 73 is directly related to the retention by fitting of the rear element 57 in the housing 9. The surface of the rear element 57 in contact with the trimming element 73 exerts a pressure which is sufficient to hold the trimming element 73 in position. The force exerted to the trimming element 73 by the rear element 57 to hold the trimming blade 81 in position is for example between 2 Kg·F and 5 Kg·F. The direction of the retention force is orthogonal to the plane of the surface of the rear element in contact with the trimming element. For example the second arm 61 includes a bump shaped portion 85 which abuts on the trimming element 73, or more particularly on its trimming blade support 83.

The trimming element 73 could be a bent blade, as described for instance in patent application WO2013/050606, or a curved blade.

The trimming blade 81 extends along a trimming axis. The trimming axis can coincide with the longitudinal axis X-X.

In an embodiment of the present invention, for example as shown in FIG. 2, a portion of the housing 9 is located forward of the trimming edge 75, and the housing 9 is provided with a trimming guard 77 located forward of the trimming edge 75. The trimming guard 77 can have a leading surface. The trimming guard 77 and more precisely the leading surface of the trimming guard 77 can define a trimming plane Pt. As represented in FIG. 2, the trimming guard 77 includes a surface which forms the leading surface. The trimming element 73 is provided without any trimming cap. The plane passing through this leading surface is the trimming plane Pt. The trimming element 73 can have a positive, a null or a negative exposure with regard to the trimming plane Pt. For example, the exposure E as illustrated in FIG. 2, is negative and equal to 5 [tm (−5 micrometers). In this embodiment of the present invention, the distance between the trimming edge 75 and the trimming guard 77 is for example about 410 micrometers. When the trimming element 73 has an exposure which is null with regard to the trimming plane Pt, the trimming edge 75 is coincident to the leading surface of the trimming guard 77.

In another embodiment of the present invention, for example shown in FIG. 7, the rear element 57 is located rearward of the trimming edge 75 whereas a portion of the housing 9 is located forward of the trimming edge 75. The housing 9 is provided with a trimming guard 77 located forward of the trimming edge 75. The rear element 57 is provided with a trimming cap 79 located rearward of the trimming edge 75. The trimming cap 79 is for example provided with a lubricating strip to be used during the trimming shaving. Thus, the rear element 57 serves as a trailing surface for both shaving and trimming. The trimming guard and more precisely the leading surface of the trimming guard can define a trimming plane Pt. As shown in FIG. 7, the trimming guard includes a surface which forms the leading surface. The trimming element 73 has for instance a positive exposure with regard to the trimming plane Pt. In other words, the trimming edge 75 extends above the trimming plane Pt. Preferably the exposure E is equal to 120 micrometers.

FIG. 2 illustrates a shaving blade cartridge including a rear element press fitted on the housing, and without any trimming cap. FIG. 7 illustrates a shaving blade cartridge including a rear element snap fitted on the housing, and with a trimming cap. In alternative embodiments of the present invention, the shaving blade cartridge can include a rear element snap fitted on the housing, and without any trimming cap, or a rear element press fitted on the housing, and with a trimming cap.

The definition of the trimming plane depends of the shape of the housing. If the trimming element has a trimming cap and a trimming guard, the definition of the trimming plane is the plane passing through the surface of the trimming guard and trimming cap which are directly near the trimming blade. If the trimming element has a trimming guard and does not have any trimming cap, the trimming plane is the plane passing through the surface of the trimming guard.

The trimming blade 81 and the trimming edge extend in a trimming edge plane Pte. An angle $\alpha$ provided between the trimming edge plane Pte and the trimming plane Pt, as shown in FIGS. 2 and 7, is between 20° and 40°. The angle $\alpha$ between the trimming edge plane Pte and the trimming plane Pt is preferably about 30°.

The trimming element 73 is for example not movable.

The distance between the trimming edge 75 and the trimming guard 77 is between 400 micrometers and 650 micrometers. The distance between the trimming edge 75 and the trimming guard 77 is for example of 580 micrometers or 590 micrometers, in particularly when the shaving blade cartridge includes a trimming cap. The distance between the trimming edge 75 and the trimming guard 77 can also be of 410 micrometers, in particularly when the shaving blade cartridge does not include a trimming cap.

As shown in FIGS. 2 and 7, the primary cutting blade 35 extends in a cutting blade plane Pbc, and the angle $\beta$ provided between the cutting blade plane Pbc and the trimming edge plane Pte can be between 120° and 150°. For example, the angle $\beta$ provided between the cutting blade plane Pbc and the trimming edge plane Pte is equal to 125°.

The housing 9 includes for example through holes which are provided beyond the trimming blade 81. The through holes may have a rectangular shape. The through holes allow through flow of rinsing water after the trimming.

The primary cutting blade 35 is retained in the housing 9 by a retainer or a clip 87. As shown in FIG. 1, the shaving blade cartridge 1 includes two clips 87, 89 retaining the primary cutting blades in the housing. The two clips 87, 89 are for example identical. However, the two clips 87, 89 may be different, and for example they may have different dimensions, different shapes, or different positioning.

The clips 87, 89, as shown in FIG. 1, each have a first leg 90, a second leg 91 and a clip body 93. The clip body 93 extends between the first and second legs 90, 91. The clip body 93, first leg 90 and second leg 91, form a one-piece part.

As shown in FIG. 1, the first leg 90 of the clip 87, 89 surrounds the first longitudinal side 15 of the housing 9, and at least a portion of the bottom side 13 of the housing 9. In other words, a portion of the clip 87, 89 is wrapped around a portion of the housing 9. The clip body 93 is arranged facing the top side 11 of the shaving blade cartridge 1. More precisely, the clip body 93 is facing the cutting edge of the at least one cutting blade 35. In order to avoid any interference with the shaving, the clip body 93 is arranged towards the longitudinal ends 37, 39 of the primary cutting blade 35, and toward the free ends 63, 65 of the rear element 57. For example, the first clip 87 is arranged between the first longitudinal end 37 and the first free end 63 of the rear element 57, whereas the second clip 89 is arranged between the second longitudinal end 39 and the second free end 65 of the rear element 57. The clip body 63 extends along the transversal axis Y-Y.

The second leg 91 of the clip 87, 89 is for example received in a through hole 95 provided in the housing 9. The through hole 95 extends transversely to the longitudinal axis X-X along the lateral axis Z-Z through the housing 9 between the top side 11 and the bottom side 13. The through hole 95 is neither a slot nor a groove. The through hole 95 extends through the housing 9 and when viewed in transversal cross-sectional view is laterally surrounded by the housing's material. The through hole 95 is located adjacent to the primary guard 55.

The second leg 91 of the clip 87, 89, which is received in the through hole 95, is bent around at least a portion of the bottom side 13. The second leg 91 of the clip 87, 89 can extend in a groove provided on the bottom side 13 of the housing 9. For example, the groove for the second leg 91 is in the continuity of groove(s) provided for the first leg.

The trimming element 73 is smaller in length than the distance between the two clips 87, 89 along the longitudinal axis (X-X). In other words, the trimming element 73 extends between the two clips 87, 89, without contact between the clip 87, 89 and the trimming element 73. The trimming element 73 is not maintained or fastened to the housing 9 by the clips 87, 89. The sole retention force or fastening force which maintains the trimming element 73 to the housing 9 is the clamping force of the rear element 57. More particularly, the trimming blade 81 is smaller in length than the distance between the two clips 87, 89.

In a similar way, the rear element 57 is smaller in length than the distance between the two clips 87, 89 along the longitudinal axis (X-X). In other words, the rear element 57 extends between the two clips 87, 89, without contact between the clip 87, 89 and the rear element 57. The rear element 57 is not maintained or fastened to the housing by the clips.

The length of the rear element 57 may correspond to the distance between the two clips along the longitudinal axis (X-X), and a portion of the clip may be wrapped around a portion of the rear element 57. In an alternative embodiment of the present invention, the trimming element can be retained by the rear element and by the clips.

The design of the shaving blade cartridge 1 allows a cost-effective recycling of the material parts since the disassembly of the trimming blade is neither expensive nor sophisticated. Thus, the environmental impact is reduced.

In order to manufacture a shaving blade cartridge according to the present invention, the following steps can be realized.

The primary guard can be provided and be assembled to the housing.

Figure 8:
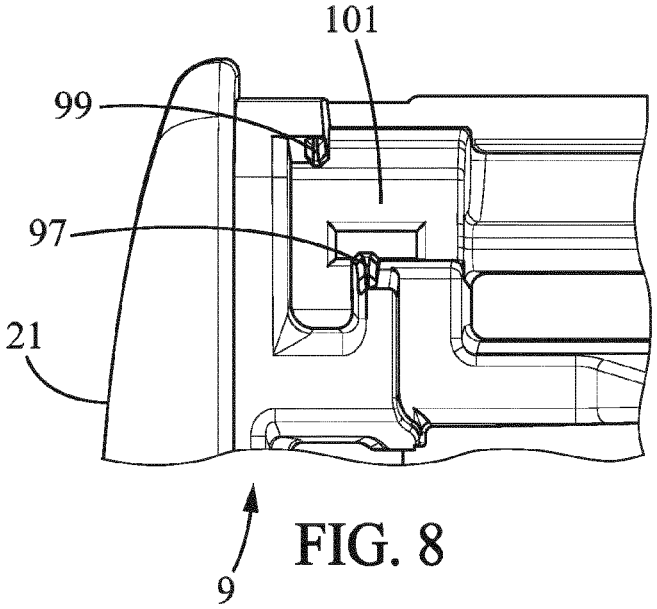
FIG. 8 is a detailed view of circle portion VIII of FIG. 4 showing a protrusion provided on the housing toward a lateral side.

The trimming element 73 can be placed on the housing. The housing 9 can be provided with arrangements 97, 99 which allow the holding of the trimming element 73 before the fixation of the same. The arrangements 97, 99 can be provided toward the first and the second lateral side 19, 21 of the housing 9. For example, as shown in FIGS. 4 and 8, the housing 9 can be provided with a protuberance 97, 99 which extends along the lateral axis Y-Y. As shown in FIG. 8, toward the second lateral side 21 of the housing 9, two protuberances 97, 99 are provided on the housing 9. The protuberances 97, 99 are located on each side of the housing's area 101 designed to receive the trimming element 73. More precisely, if the trimming element 73 includes a trimming blade support, the protuberances 97, 99 are provided on each side of the housing's area 101 designed to receive the trimming blade support. The two protuberances 97, 99 are not facing each other, but are offset from each other. In particular, as shown in FIG. 8, the two protuberances 97, 99 are slightly offset from each other along the longitudinal axis X-X. In an embodiment of the present invention, the protuberances can be facing each other. The two protuberances 97, 99 enable holding of the trimming element. More precisely, the trimming element is sandwiched between the two protuberances 97, 99 along the lateral axis Y-Y. Similar protuberances 97, 99 can be provided toward the first lateral side 19 of the housing. Thus, a total of four protuberances 97, 99 can hold the trimming element on the housing 9. The protuberances 97, 99, as shown in FIG. 8, have a triangular shape, and a bottom of the triangle is toward the bottom side 13 of the housing 9 whereas a top of the triangle is toward the top side 11 of the housing 9. However, others shapes can be used. The protuberances 97, 99 may be used independently with the first embodiment as illustrated in FIG. 2, or with the second embodiment, as illustrated in FIG. 7. As detailed hereafter and in reference to FIGS. 10A-B and 11-11B, the protuberances 97, 99 can be of different shapes.

In a further step, the trimming element 73 can be fixed by fitting the rear element 57 on the housing 9. The primary cutting blades 35 are mounted on the housing 9 between the first and second longitudinal sides 15, 17, such that the primary guard 55 is located forward of the cutting edge 41. The clips can then be mounted to form the shaving blade cartridge 1. At the end of the method of the manufacture of the shaving blade cartridge according to the present invention, the trimming element 73 is sandwiched between the housing 9 and the primary cap 53.

In at least one embodiment of the present invention, the steps described above can be performed successively. The assembly process is thus relatively straight forward, easily flexible, and quickly adaptable to different shaving blade cartridges.

According to another method, the primary guard 55 and the housing 9 are one piece; there is no step of assembling the primary guard 55 on the housing 9. The method of manufacturing a shaving blade cartridge can also include:

providing a housing 9 extending along a longitudinal axis X-X having a top side 11 and a bottom side 13 opposite to the top side 11 and first and second longitudinal sides 15, 17 each extending longitudinally along the longitudinal axis X-X between the top and bottom sides 11, 13, the housing being provided with a primary guard 55, providing a trimming element 73 having a trimming edge 75, placing the trimming element 73 on the housing 9, the housing 9 having protrusions 97, 99 being arranged to hold the trimming element 73, providing a rear element 57, fixing the trimming element on the housing by fitting the rear element on the housing, mounting a primary cutting blade 35 on the housing 9 between the first and second longitudinal sides 15, 17, the primary cutting blade 35 having a cutting edge 41 such that the cutting edge 41 and the trimming edge 75 are opposite, the primary guard 55 being located forward of the cutting edge 41.

Figure 10A:
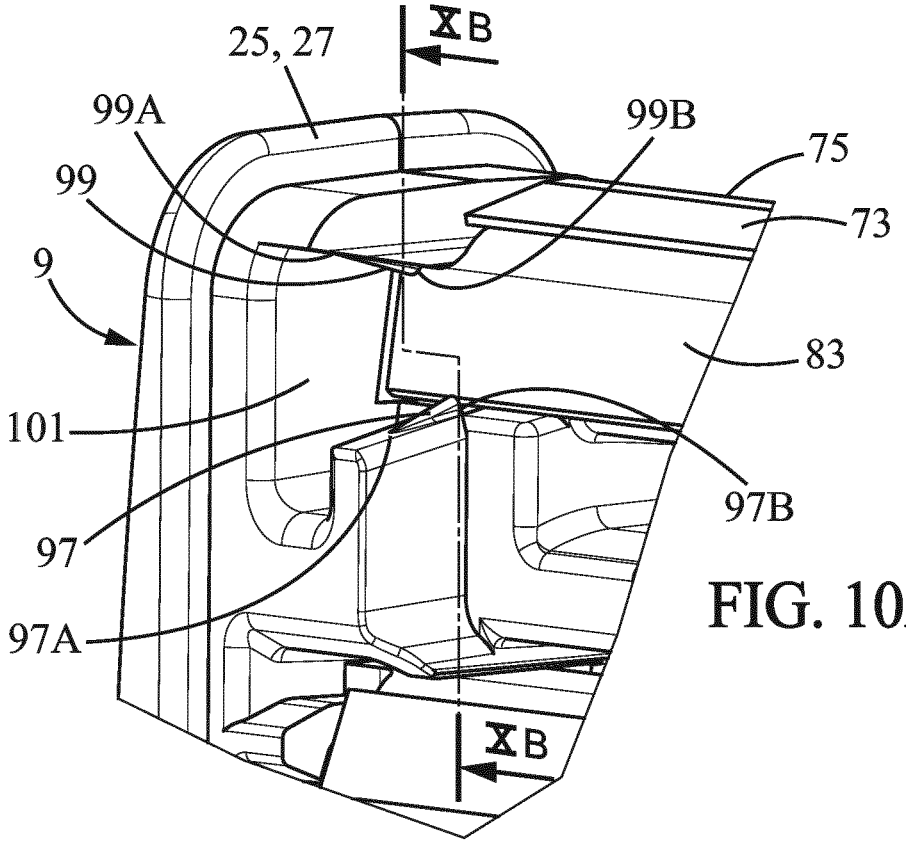
FIG. 10A is perspective view of the detail of FIG. 8 according to one embodiment of the present invention, where the trimming blade is being placed.
Figure 10B:
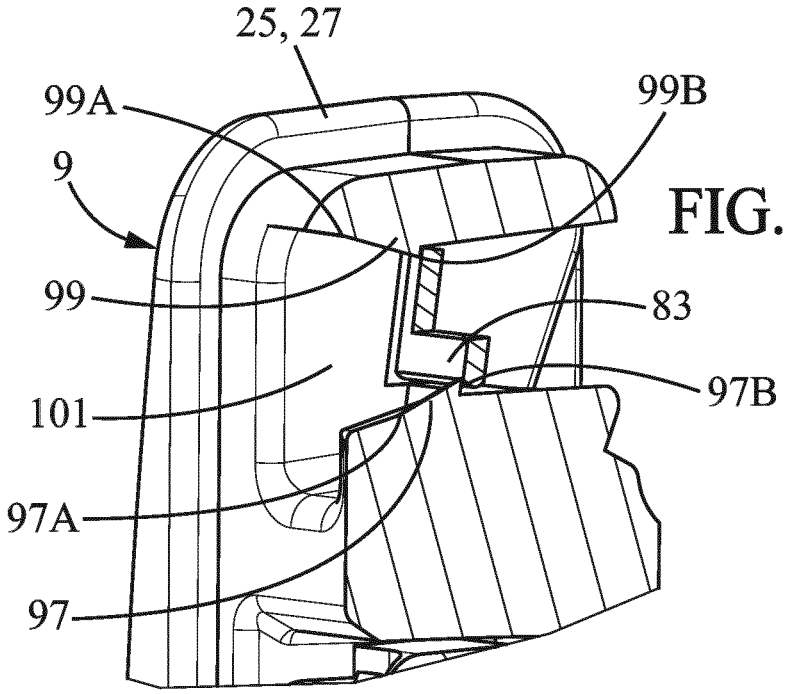
FIG. 10B is a cross-sectional view of FIG. 10A according to line XB-XB.

FIG. 10A illustrates a perspective view of the detail of FIG. 8 according to one embodiment of the present invention, the trimming blade being placed. More precisely, the trimming blade 73, especially the trimming blade support 83 (when it exists) is maintained in the housing 9, for instance after having being snap-fitted in the housing's area 101. As illustrated in FIG. 10A and also in FIG. 10B, the protuberances 97, 99 provided on each side of the housing's area 101 have a triangular shape. The protuberances 97, 99 are each provided at one end with an apex 97A, 99A facing toward the top side 11 of the housing 9 and on the other end with a shoulder or abutment face 97B, 99B. The abutment faces 97B and 99B firmly retain the trimming blade 73, especially the trimming blade support 83, in place.

Figure 11A:
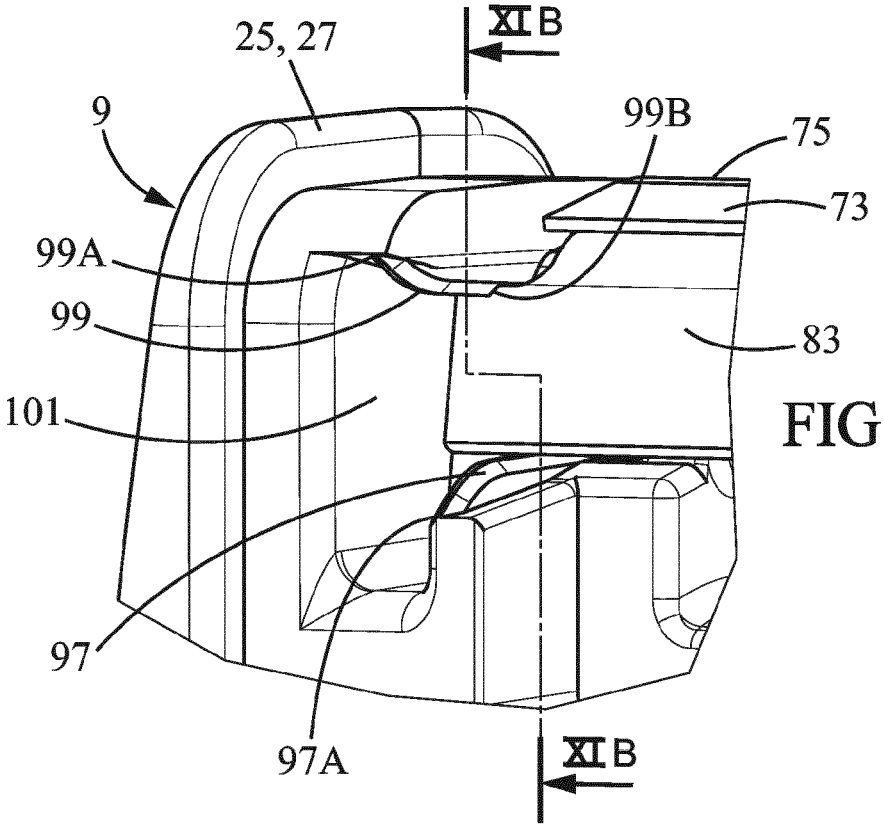
FIG. 11A is perspective view of the detail of FIG. 8 according to another embodiment of the present invention, where the trimming blade is being placed.
Figure 11B:
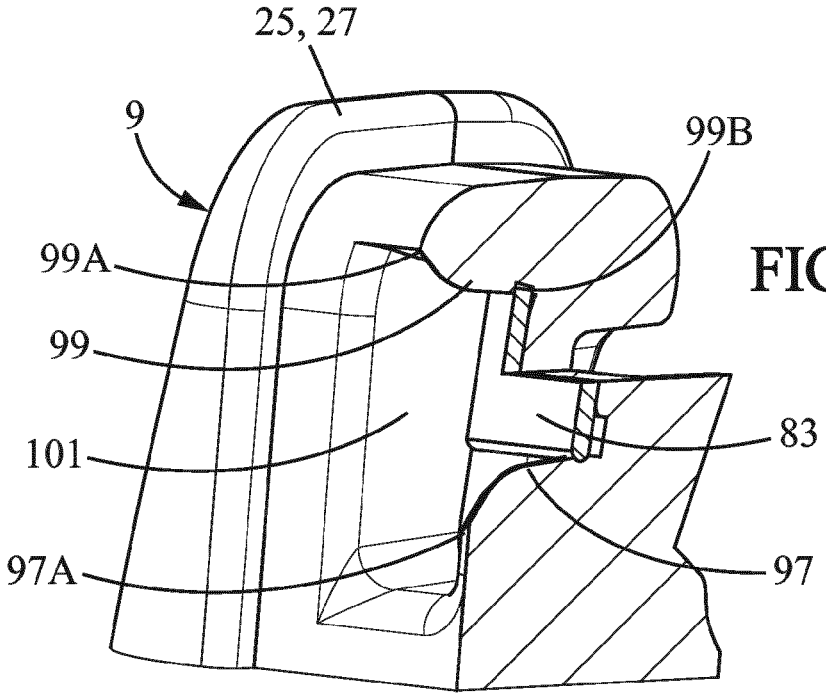
FIG. 11B is a cross-sectional view of FIG. 11A according to line XIB-XIB.

FIG. 11A illustrates a perspective view of the detail of FIG. 8 according to another embodiment of the present invention, showing the trimming blade being placed. More precisely, the trimming blade 73, especially the trimming blade support 83 (when it exists) is maintained in the housing 9, for instance after having being press-fitted in the housing's area 101. As illustrated on FIG. 11A and also in FIG. 11B, the protuberances 97, 99 provided on each side of the housing's area 101 have a curve shape. The protuberances 97, 99 are each provided at one end with an apex 97A, 99A facing toward the top side 11 of the housing 9. On the other end, the protuberance 99 is provided with a shoulder or abutment face 99B. The abutment face 99B retains firmly the trimming blade 73, especially the trimming blade support 83 in place.

In the embodiments illustrated in FIGS. 10A-B and 11A-B, the protuberances 97, 99 have the same shape. The description is with regard to one of the two sides of the housing's area 101 (near the longitudinal end 25 of the first longitudinal side 15 and the free end 27); at the opposite side (near the longitudinal end 23 of the first side 15 and the free end 27), the same protuberances 97, 99 are provided. The shape of the protuberances 97 and 99 can be the same with regard to the other (on the same side of the housing).

In another embodiment of the present invention, the shape of the protuberances 97 and 99 are different with regard to the other (on the same side of the housing). In another embodiment, the shape of the protuberances 97 and 99 are different on one side of the housing (near the longitudinal end 25 of the first longitudinal side 15 and the free end 27) with regard to the other side (near the longitudinal end 23 of the first side 15 and the free end 27). Any kind of shape and/or any combination of the shapes can be provided on the housing 9 according to the present invention.

The invention claimed is:

1. A shaving blade cartridge comprising:

a housing extending along a longitudinal axis (X-X), having a top side, a bottom side opposite to the top side and first and second longitudinal sides, each extending longitudinally along the longitudinal axis (X-X) between the top and bottom sides and being approximately parallel, the housing being provided with a through hole extending transversally to the longitudinal axis (X-X) through the housing between the top side and the bottom side;

at least one primary cutting blade mounted in the housing between the first and second longitudinal sides, and having a cutting edge extending along the longitudinal axis (X-X);

a rear element extending along the first longitudinal side and being fitted in the housing;

a trimming element mounted on the housing and having a trimming edge extending along the longitudinal axis, the trimming element being retained between the housing and the rear element, the trimming edge extending in a direction towards the first longitudinal side and the cutting edge extending in a direction away from the first longitudinal side;

a clip retaining the at least one primary cutting blade in the housing and having a first leg, a second leg and a clip body extending between the first and second legs, the first leg and the second leg of the clip being approximately parallel;

wherein at least a portion of the first leg of the clip (i) is exposed by the housing, and (ii) extends around and surrounds the first longitudinal side and at least a portion of the bottom side of the housing, and wherein at least a portion of the second leg of the clip is (i) received in the through hole, and (ii) concealed by the housing.

2. The shaving blade cartridge according to claim 1, including a recess being formed in the housing, the recess being located between the at least one primary cutting blade and the first longitudinal side.

3. The shaving blade cartridge according to claim 2, wherein the rear element includes a first arm and a second arm, the first arm being transverse to the second arm, and an end of the first arm being fixed to a middle portion of the second arm.

4. The shaving blade cartridge according to claim 3, wherein the first arm of the rear element is press-fit in the recess formed in the housing, while the second arm extends outside of the housing.

5. The shaving blade cartridge according to claim 3, wherein the first arm of the rear element is snap-fit in the recess formed in the housing.

6. The shaving blade cartridge according to claim 4, wherein the recess defines an interior wall, the interior wall including a plurality of protrusions, the plurality of protrusions being provided to interact with the rear element when the first arm is press-fit into the recess.

7. The shaving blade cartridge according to claim 5, wherein the recess defines an interior wall, the interior wall including a plurality of protrusions, the plurality of protrusions being provided to interact with the rear element when the first arm is snap-fit into the recess.

8. The shaving blade cartridge according to claim 6, wherein the protrusions are deformable.

9. The shaving blade cartridge according to claim 7, wherein the protrusions and the rear element are deformable.

10. The shaving blade cartridge according claim 1, wherein the rear element and the housing defines a slot and the trimming element is fastened to the housing by the rear element.

11. The shaving blade cartridge according to claim 10, wherein the trimming edge being directed toward the bottom side of the housing and the cutting edge being directed beyond the top side of the housing.

12. The shaving blade cartridge according to claim 11, wherein the trimming element includes a trimming blade and a trimming blade support, the trimming blade including the trimming edge, and the trimming blade support being received in the slot defined by the rear element and the housing.

13. The shaving blade cartridge according to claim 12, wherein the trimming blade support being fastened to the housing by the snap-fit of the rear element into the housing.

14. The shaving blade cartridge according to claim 12, wherein the second arm of the rear element includes a portion configured to exert a retention force on the trimming blade support of the trimming element.

15. The shaving blade cartridge according claim 1, wherein a length of the rear element is smaller than a length of the housing.

16. The shaving blade cartridge according claim 7, wherein the first arm includes a hook, the hook being configured to cooperate with the plurality of protrusions.

* * * * *